US007496307B2

(12) United States Patent
Mitsuya et al.

(10) Patent No.: US 7,496,307 B2
(45) Date of Patent: Feb. 24, 2009

(54) FIXING DEVICE AND ELECTRO-PHOTOGRAPHIC RECORDING APPARATUS USING THE SAME

(75) Inventors: Teruaki Mitsuya, Ibaraki (JP); Takashi Suzuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 197 days.

(21) Appl. No.: 11/703,724

(22) Filed: Feb. 8, 2007

(65) Prior Publication Data

US 2007/0212085 A1 Sep. 13, 2007

(30) Foreign Application Priority Data

Feb. 10, 2006 (JP) ..... P2006-033458

(51) Int. Cl.
*G03G 15/00* (2006.01)
*G03G 15/20* (2006.01)

(52) U.S. Cl. ..... 399/67; 399/322

(58) Field of Classification Search ..... 399/67, 399/320, 322–324, 400
See application file for complete search history.

(56) References Cited

U.S. PATENT DOCUMENTS 5,436,709 A * 7/1995 Sakaizawa et al. ..... 399/69
5,671,473 A * 9/1997 Yamada et al. ..... 399/320

FOREIGN PATENT DOCUMENTS

JP 58-76870 5/1983
JP 6-19357 1/1994

* cited by examiner

*Primary Examiner*—Hoang Ngo
(74) *Attorney, Agent, or Firm*—McGinn IP Law Group, PLLC

(57) ABSTRACT

An axis-to-axis distance between a heating roller and a back-up roller is expanded beforehand in inserting a thick paper to prevent a rush/exhaust impact when fixing the thick paper without changing a condition of pressing mechanism.

6 Claims, 4 Drawing Sheets

FIXING DEVICE AND ELECTRO-PHOTOGRAPHIC RECORDING APPARATUS USING THE SAME

CROSS-REFERENCE TO RELATED APPLICATIONS

This application is based on and claims the benefit of priority from the prior Japanese Patent Application No. 2006-033458, filed on Feb. 10, 2006; the entire contents of which are incorporated herein by reference.

BACKGROUND

1. Technical Field

The present invention relates to an electro-photographic recording apparatus such as a printer, a facsimile or a copying machine that visualizes an image using colored particles such as a toner, and more particularly to a fixing device fixing a toner image on a recording medium.

2. Description of Related Art

A recording apparatus using the electro-photographic method has a development process of visualizing the colored particles as the image on the surface of the recording medium, and a fixing process of fixing the visualized image of colored particles on the recording medium. For the colored particles, the powder called the toner intended for electrophotography is employed. The toner is molten by heating, and solidified by cooling. In the fixing process, the toner is heated and molten, and fixed on the recording medium, using the property of the toner.

The device for fixing the toner image on the recording medium relied on a method (roller fixing) in which a backup roller (counter roller) is pressed against a heat roller (heating roller) heated by a halogen heater disposed inside the roller by a coil spring or the like to form a nip part between the rollers, and the recording medium with the toner deposited is passed through the nip part to fix the toner by pressure and heat. Hereinafter, the heat roller is referred to as "HR", and the backup roller is referred to as "BR". Both the rollers HR and BR are called a fixing roller pair. Also, any one of the HR and BR is often called a fixing roller. The HR is heated, and the HR and BR are pressed together and rotated. By inserting the recording paper through this contact plane, the toner arranged as the image on the surface of the recording paper is fixed. Herein, at least one fixing roller may be heated. Also, when the toner image formed on the recording paper is inserted through the fixing roller pair, a carrying plane of the toner image is contacted with the heated fixing roller in inserting the toner image. In the fixing device, the toner may adhere to the fixing roller in fixing the toner image. This phenomenon is called an offset, and the toner adhering to the fixing roller is called an offset toner. If a large amount of offset toner arises, a problem arises that the offset toner re-transits to the recording medium to make no distinction from the recording medium, and cause a misprint. In the fixing device having a cleaner, the amount of toner to be wiped is increased, resulting in a problem that the exchange period of a cleaning member is shortened.

FIG. 1 is a graph showing an occurrence characteristic of the offset toner in a fixing device. Reference numeral 19 denotes a low temperature area, reference numeral 20 denotes a high temperature area, and reference numeral 21 denotes a non-offset band. The axis of abscissas represents the temperature of the heating roller, and the axis of ordinates represents the amount of offset toner. The amount of offset toner is greater in the low temperature area 19 and the high temperature area 20. The offset occurring in the low temperature area 19 is called a low temperature offset, and the offset occurring in the high temperature area 20 is called a high temperature offset. The area between the low temperature area 19 and the high temperature area 20 is called a non-offset band 21, where the amount of offset toner is small. In the fixing device, the temperature of the heating roller is usually set within the non-offset band 21 to reduce the amount of offset toner as much as possible.

The amount of offset toner is increased or decreased with the degree of load variation in an HR drive source, for example, an HR drive motor, at the time of fixing, as described in JP-A-6-19357. When the load variation is significant, the clear non-offset band 21 may not be found. This load variation occurs mainly due to a rush impact at the front end part of the recording paper in inserting the recording paper through the contact plane formed between the HR and BR, or an exhaust impact at the rear end part of the recording paper when exhausted.

The rush/exhaust impact is not large on the thin paper, in which the offset due to rush/exhaust impact is not problematical. If the thick paper is passed, a large rush/exhaust impact occurs, producing the offset at an impermissible level. To prevent the offset due to this rush/exhaust impact, a method for narrowing a range of impact coefficients for the pressing mechanism has been described in JP-A-6-19357.

SUMMARY

In the related-art fixing device as described above, it is necessary to decrease a spring constant or an arm ratio of the pressing mechanism to prevent the offset due to rush/exhaust impact, resulting in a problem that the degree of freedom in designing the pressing mechanism is lower. That is, to suppress the impact coefficient low, it is necessary to decrease the spring constant or arm ratio of the pressing mechanism (=(distance to the rotation center of the fixing roller to be pressed)/(distance from the rotation center of the pressing member to the engagement position of the pressing spring with the pressing member), whereby there was a problem that the degree of freedom in designing the pressing mechanism is lower. Also, the lower spring constant or arm ratio of the pressing mechanism leads to the increased free length of the spring for the pressing mechanism at the same time, resulting in a problem that the size of the pressing mechanism is increased.

Thus, it is an object of the invention to provide an excellent fixing device and an electro-photographic recording apparatus using the fixing device in which no misprint is produced and a long cleaning member exchange period is achieved by preventing the occurrence of an offset due to a rush/exhaust impact in inserting the thick paper without decreasing the degree of freedom in designing the pressing mechanism of the fixing device and increasing the size of the pressing mechanism.

According to an aspect of the invention, there is provided a fixing device for an electro-photographic recording apparatus, including: a back-up roller having an elastic layer on a surface of the back-up roller; and a heating roller, wherein a nip part is formed by a pressing mechanism where the back-up roller is pressed against the heating roller. A axis-to-axis distance between the heating roller and the back-up roller is set to be a first value under a first fixing condition where an offset due to a rush/exhaust impact does not have adverse effect on the recording medium in case that a thin paper as the recording medium is transported through the nip part, while the back-up roller comes into contact with the heating roller to receive a driving force from the heating roller when the recording medium is not nipped at the nip part. When a thick paper as the recording medium is fixed, the axis-to-axis distance between the heating roller and the back-up roller is set to be a second value larger than the first value under the first fixing condition, and is set to be the second value under a second fixing condition where the back-up roller comes into contact with the heating roller to receive a driving force from the heating roller.

According to another aspect of the invention, the axis-to-axis spacing between the fixing roller pair is widened beforehand by a certain interval by the pressing mechanism with a spring for pressing the fixing roller. It is assumed that the axis-to-axis distance is L (where paper is not nipped), and the axis-to-axis distance especially in a state where the axis-to-axis spacing is not widened is Lo. It is assumed that the paper thickness is D and the paper thickness (thin paper) in which there is no problem with the offset due to rush/exhaust impact is Do, the axis-to-axis distance L in passing the thick paper is set in a range as indicated by the expression (1)

$$Lo+(D-Do)\leqq L<Lo+D \quad (1)$$

In passing the thick paper, the axis-to-axis distance is widened up to the right side (Lo+D) of the expression (1), whereby the pressing force required for fixing can be applied. Further, since the axis-to-axis distance is less expanded in passing the thick paper than the thin paper in which there is no problem with the offset due to rush/exhaust impact, the rush/exhaust impact is not increased in passing the thick paper, and accordingly the offset is not problematical.

If the HR and the BR are not contacted but separated away at the axis-to-axis distance L widened by a certain interval as indicated by the expression (1), and any one of the HR and the BR is a driving roll and the other is a follower roll, the speed of the follower roll is decreased, producing a speed difference between the HR and the BR, and applying a shearing stress on the toner at the time of fixing. This also causes the offset.

According to still another aspect of the invention, even if the axis-to-axis distance is widened, its extension is made within a deformation range of the elastic layer for the backup roller, and the heat roller and the backup roller are kept in contact, so that there is no difference in the speed of rotation between the heat roller and the backup roller. Therefore, the heat roller and the backup roller are kept in contact by satisfying the expression (1) and the expression (2), so that there is no difference in the speed of rotation between the heat roller and the backup roller, whereby the occurrence of offset can be securely prevented.

$$Lo+D<r_H+r_B \quad (2)$$

where $r_H$ is the radius of the HR and $r_B$ is the radius of the BR.

DESCRIPTION OF THE EMBODIMENTS

Embodiments of the present invention will be described below.

Embodiment 1

Referring to FIGS. 2 to 6, embodiments of the invention will be described below.

Figure 1:
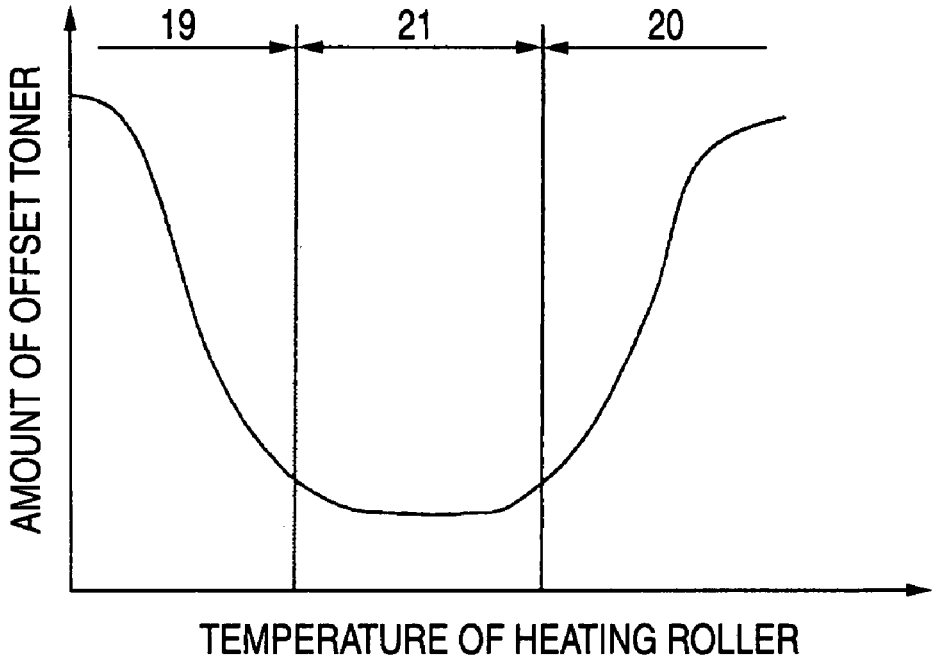
FIG. 1 is a graph showing an occurrence characteristic of offset toner in the fixing device.
Figure 2:
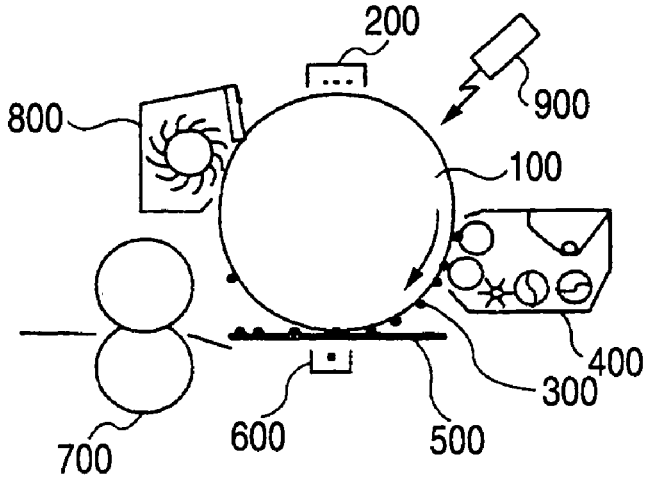
FIG. 2 is a cross-sectional side view of an electro-photographic apparatus according to a first embodiment.

FIG. 2 is a cross-sectional side view of an electro-photographic apparatus according to an embodiment 1 of the invention. Reference numeral 100 denotes a photosensitive drum, reference numeral 200 denotes a charger unit, reference numeral 300 denotes a toner, reference numeral 400 denotes a developing unit, reference numeral 500 denotes a recording medium, 600 denotes a transfer unit, reference numeral 700 denotes a heat roll fixing device, reference numeral 800 denotes a cleaner, and reference numeral 900 denotes an exposure unit. On the surface of the photosensitive drum 100 uniformly charged by the charger unit 200, an electrostatic latent image is formed by the exposure unit 900 composed of a semiconductor laser and an optical system in which the emission of light is controlled by an exposure control unit having a laser driver. Thereafter, the electrostatic latent image is developed with the toner 300 by the developing unit 400. The toner 300 is transferred onto the recording medium 500 such as the recording paper by the transfer unit 600. Thereafter, the transferred toner image is heated and molten, and fixed on the recording medium 500 by the fixing unit 700. The recording medium 500 heated by the heat roll fixing device 700 is stacked on a paper output stacker (not shown).

Figure 3:
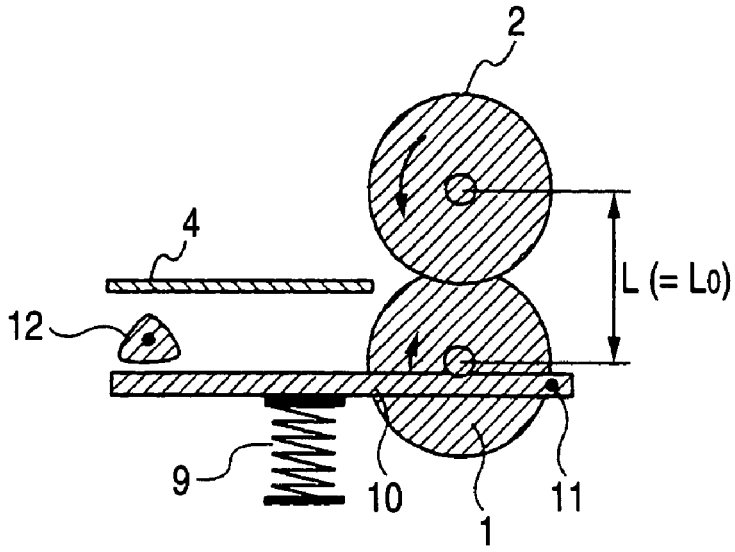
FIG. 3 is a cross-sectional side view typically showing the heat roll fixing device 700 when fixing a thin paper in the first embodiment.
Figure 4:
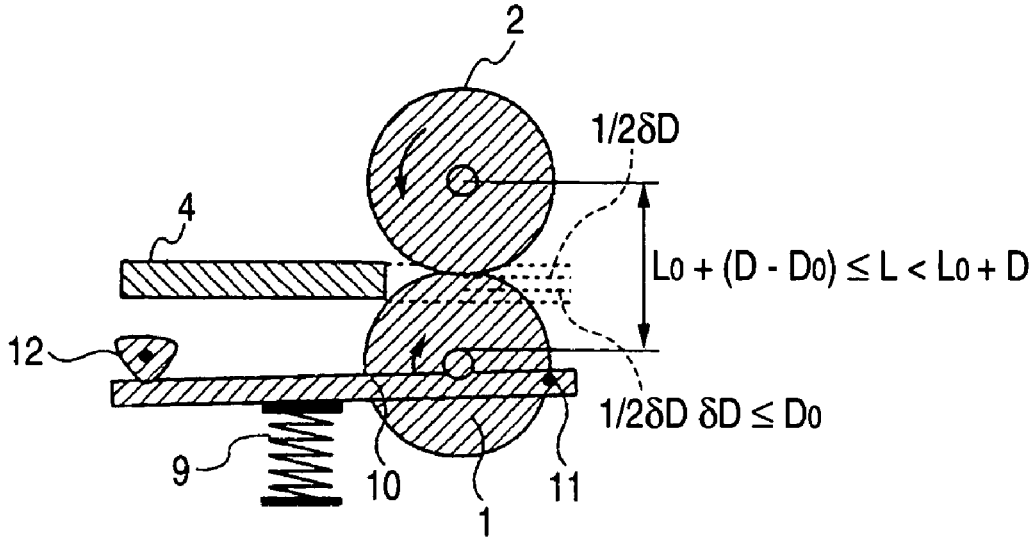
FIG. 4 is a cross-sectional side view typically showing the heat roll fixing device 700 when fixing the thick paper in the first embodiment.

FIGS. 3 and 4 are cross-sectional side views typically showing the heat roll fixing device 700 for the recording apparatus as shown in FIG. 2. Reference numeral 1 denotes a backup roller (counter roller), reference numeral 2 denotes a heat roller (HR), reference numeral 4 denotes a recording paper, reference numeral 9 denotes a pressing spring, reference numeral 10 denotes an arm in the pressing mechanism, reference numeral 11 denotes a fulcrum of the arm, and reference numeral 12 denotes an axis-to-axis distance adjusting cam. The heat roller (HR) 2 is coated with a heat resistant mold release layer on its surface, and internally has a halogen heater as a heat source, which controls the temperature of the HR or BR to be a predetermined value. The backup roller 1 has an elastic layer such as a heat resistant rubber layer on the surface.

In the heat roll fixing device 700 of this embodiment, a fixing method (roller fixing) is employed in which the backup roller 1 is pressed against the heat roller 2 heated by the halogen heater disposed inside the roller by the pressing mechanism composed of the spring 9 and the arm 10 to form a nip part between one pair of rollers, and the recording paper 4 with the toner deposited is passed through the nip part to fix the toner by pressure and heat. The nip part is configured so that the heat roller contacts the elastic layer of the counter roller even in a no-paper state. The heat roller 2 is driven, and the backup roller 1 follows the heat roller 2 by making contact with the heat roller 2. The drive motor of the heat roller 2 of this embodiment 2 is desirably a DC brushless motor.

In the heat roll fixing device 700 of this embodiment, the axis-to-axis distance L between the BR1 and the HR2 is changed with the thickness of paper. Firstly, FIG. 3 shows a constitution where the recording paper 4 is the thin paper.

The axis-to-axis distance L between the BR1 and the HR2 is initially set to a value (L=Lo) under such thin paper fixing conditions that the elastic layer of the BR1 is contacted under pressure with the surface of the HR2 so that the BR1 receives a driving force from the HR2 in a state where no paper is nipped and there is almost no problem with the offset due to a rush/exhaust impact when the recording paper 4 of thin paper runs between BR1 and HR2. Thereby, if the recording paper 4 is the thin paper, there is no difference in the peripheral speed on the contact plane between the BR1 and the HR2 when the thin paper runs in. Since the impact caused by a change in the axis-to-axis distance is absorbed owing to a deformation of the elastic layer, there is no problem with the offset due to a rush/exhaust impact.

In the case of the thick paper, the axis-to-axis distance L between the BR1 and the HR2 is widened by the paper thickness, for example, as compared with the case of the thin paper. FIG. 4 shows a constitution where the recording paper 4 is the thick paper. If the thick paper is inserted while the axis-to-axis distance is kept equivalent to that where the recording paper 4 is the thin paper, an offset occurs due to a rush/exhaust impact, whereby to avoid this offset, the axis-to-axis distance between the BR1 and the HR2 is widened by the axis-to-axis distance adjusting cam 12 before the thick paper runs in. A range for widening the axis-to-axis spacing is within the deformation range of the elastic layer for the BR1, and a slave state where the BR1 is contacted with the HR2 is maintained.

The axis-to-axis distance L between the BR1 and the HR2 is changed according to the thickness of paper by a manipulation of the operator at the time of printing, but may be automatically adjusted by determining the printing medium used in the electro-photographic recording apparatus.

The rush/exhaust impact caused where the paper is inserted between the BR1 and the HR2 can be monitored with the current waveform inputted into a motor (not shown) for driving the heat roller 2.

Figure 5:
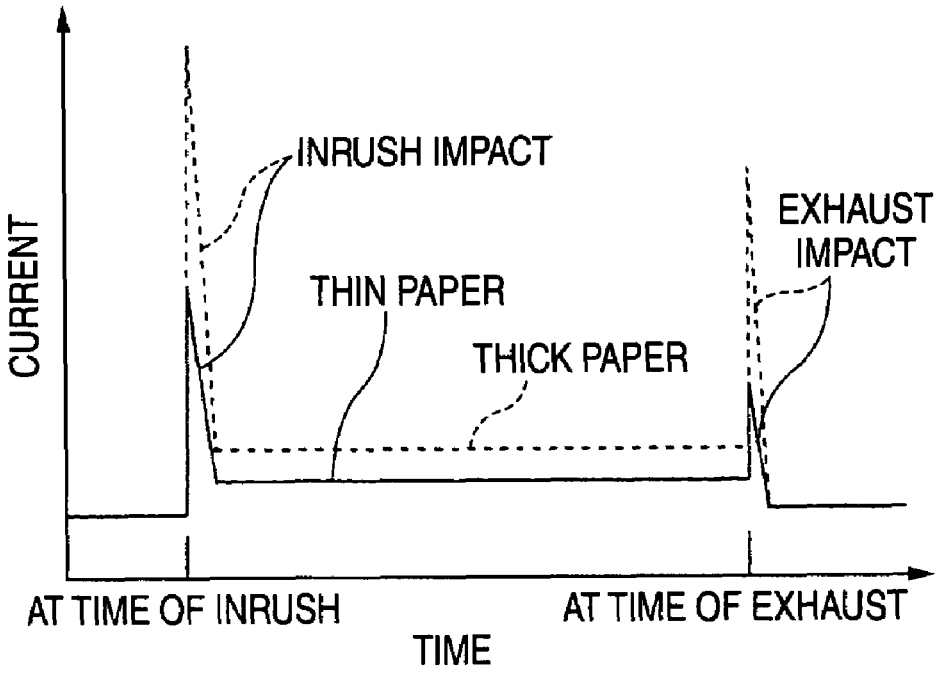
FIG. 5 is a graph typically showing a current waveform when the thin paper or the thick paper is inserted while the same axis-to-axis distance is kept as in the thin paper, employing a DC brushless motor as the drive motor.

FIG. 5 typically shows the current waveform when the thin paper or the thick paper is inserted while the same axis-to-axis distance is kept as in the thin paper, employing a DC brushless motor as the drive motor. It will be found that the in rush impact current at the time of inrush and the exhaust impact current at the time of exhaust are larger as the thickness of paper is increased. The recording apparatus of this embodiment supports the paper thickness of 55 kg paper (paper thickness: about 80 micron) in terms of paper ream weight. Particularly, there is no problem with the offset due to inrush impact if the ream weight is 70 kg paper or less. Accordingly, the axis-to-axis spacing is widened in accordance with the expression (1) in fixing 90 kg paper, 110 kg paper and 135 kg paper. Thereby, the inrush impact current and exhaust impact current when the thick paper is inserted are suppressed to be as low as when the thin paper is inserted. In the following embodiment, the recording paper with ream weight of 70 kg paper or less is called the thin paper, and the recording paper with ream weight of 90 kg paper or less is called the thick paper.

Assuming that the axis-to-axis distance between the backup roller 1 and the heat roller 2 in a state where a thin recording paper 4 is not nipped by the fixing rollers is Lo, and the thickness of the thin recording paper 4 is Do, the axis-to-axis distance between the backup roller 1 and the heat roller 2 while the recording paper 4 is being nipped has been widened by Do, so that the axis-to-axis distance between the backup roller and the heat roller 2 is Lo+Do. In case that the recording paper 4 is thin, there is no problem with the offset due to rush/exhaust impact. The strength of rush/exhaust impact depends on the widened distance. As the widened distance is greater, the rush/exhaust impact is stronger. When the recording paper 4 is thick, if the widened distance is less than Do, there is no problem with the offset due to rush/exhaust impact.

In a fixing device according to the embodiment, the axis-to-axis distance between the backup roller 1 and the heat roller 2 is widened beforehand by activating the axis-to-axis distance adjusting cam 12 (axis-to-axis distance adjusting member) in case that the recording paper 4 is thick, so that the widened distance is set not to be over Do, even when the thick recording paper 4 is inserted. When the recording paper 4 is thick, this condition is represented by the expression (1), $$Lo+(D-Do)\leqq L<Lo+D \quad (1)$$

where the thickness of paper is D.

Assume that the axis-to-axis distance is L (in a state where the paper is not nipped by the fixing rollers), the axis-to-axis distance in a state where the axis-to-axis spacing is not widened is Lo, the paper thickness is D, and the paper thickness (thin paper) in which there is no problem with the offset due to rush/exhaust impact is Do, the axis-to-axis distance L in passing the thick paper is set in a range as represented by the expression (1).

$$Lo+(D-Do)\leqq L<Lo+D \quad (1)$$

In passing the thick paper, since the axis-to-axis distance is widened up to (Lo+D) in the right side of the expression (1), the pressing force for fixing can be applied.

In the case of the thick paper, if the axis-to-axis distance between the backup roller 1 and the heat roller 2 is widened beforehand to satisfy this condition represented by the expression 1, the widened distance (supposed as δD) in inserting the thick paper is not in excess of the widened distance Do in the case of the thin paper.

As regards the expression (1), the spring 9 of the pressing mechanism is pressed by the arm 10 and contracted from the free length to produce a pressing force at any time. As one example, the paper thickness of the thin paper is 80 μm, and the paper thickness of the thick paper is 200 μm. As regards the spring 9 of the paper pressing mechanism, since a displacement amount of the spring 9 due to a difference in the paper thickness is as small as microns, the difference in the paper thickness has substantially negligible influence on the pressing force in the expression (1). Therefore, in this embodiment, as the spring 9 of the pressing mechanism, the spring for the thin paper is always employed, and copes with the thick paper.

Figure 6:
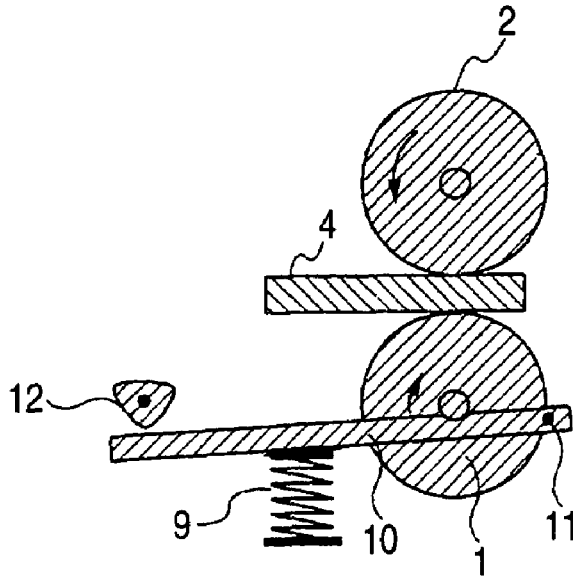
FIG. 6 is a cross-sectional side view typically showing the heat roll fixing device 700 in a state where the thick paper is nipped at the time of fixing the thick paper in the first embodiment.

FIG. 6 is a cross-sectional side view typically showing the heat roll fixing device 700 in a state where the thick paper is nipped. The state of the pressing mechanism where the thick paper is nipped is illustrated. The axis-to-axis distance adjusting cam 12 as the axis-to-axis distance adjusting member is separated away from the arm 10 while the thick paper is nipped. If the axis-to-axis distance adjusting cam 12 is in contact with the arm 10, the pressing force of the spring 9 is shared on the axis-to-axis distance adjusting cam 12 even during the fixing. The nip part is not appropriately formed. Accordingly, the axis-to-axis distance is set to satisfy the condition where the axis-to-axis distance adjusting cam 12 is separated away from the arm 10, while the thick paper is nipped.

If the backup roller 1 and the heat roller 2 are separated away without contact in the axis-to-axis distance L widened by a predetermined interval as represented by the expression (1), the speed of the backup roller 1 that is a slave roller is decreased, producing a speed difference between the backup roller 1 and the heat roller 2 to cause a shearing stress to act on the toner at the time of fixing. This also causes an offset. Accordingly, in the fixing device, even if the axis-to-axis distance is widened, its expansion is made within a deformation range of the elastic layer of the backup roller, and the heat roller and the backup roller are always maintained in contact to prevent the occurrence of a speed difference in the rotation between the heat roller and the backup roller. Therefore, the expression (1) and the expression (2) are satisfied, and the heat roller and the backup roller are maintained in contact to suppress a speed difference in the rotation between the heat roller and the backup roller, whereby the occurrence of the offset is prevented more securely.

$$Lo+D<r_H+r_B \tag{2}$$

Where $r_H$ is the radius of the HR and $r_B$ is the radius of the BR. That is, even if the axis-to-axis distance between the backup roller 1 and the heat roller 2 is widened in passing the thick paper, it is required that the surfaces of the backup roller 1 and the heat roller 2 are contacted. Thereby, the rotation speed of the backup roller 2 is not decreased, preventing the action of a shearing stress due to a speed difference to cause the offset.

With this embodiment as described above, even if the thick paper is inserted through the nip part, the rush/exhaust impact is not increased, whereby there is no problem with the offset. In this case, it is unnecessary that the spring constant or the arm ratio of the pressing mechanism is designed to be low, whereby the degree of freedom in design is not lowered and the size of the pressing mechanism is not increased.

Modification of Embodiment 1

While in the embodiment 1 one axis-to-axis distance adjusting cam 12 is employed to deal with all kinds of thick paper of 90 kg paper or more, a quite large number of sheets of paper with the specific paper thickness may be continuously employed according to an application purpose. Thus, a plurality of axis-to-axis distance adjusting cams 12 may be prepared corresponding to the paper thickness of 110 kg paper, 135 kg paper and so on, and exchanged at the time of printing.

Also, the axis-to-axis distance adjusting cam 12 may be of a stepless type, whereby the axis-to-axis distance is changed according to the paper thickness.

Moreover, while in this embodiment, the cam 12 for pressing the arm is employed to adjust the axis-to-axis distance, the cam may not be necessarily employed, but other axis-to-axis distance adjusting mechanisms such as a solenoid or a link mechanism may be employed. In this case, the separation where the thick paper is nipped between the BR1 and the HR2 is a necessary condition. That is, it is generally required that no force is applied on the member for axis-to-axis distance adjustment while the thick paper is nipped.

As regards the recording medium other than the paper, the same idea as in this embodiment can be applied. The recording medium having the thickness where the offset due to inrush impact does not adverse affect on the paper is defined as the thin paper (or the thin recording medium), and the thicker recording medium is defined as the thick paper (or the thick recording medium)

Embodiment 2

Figure 7:
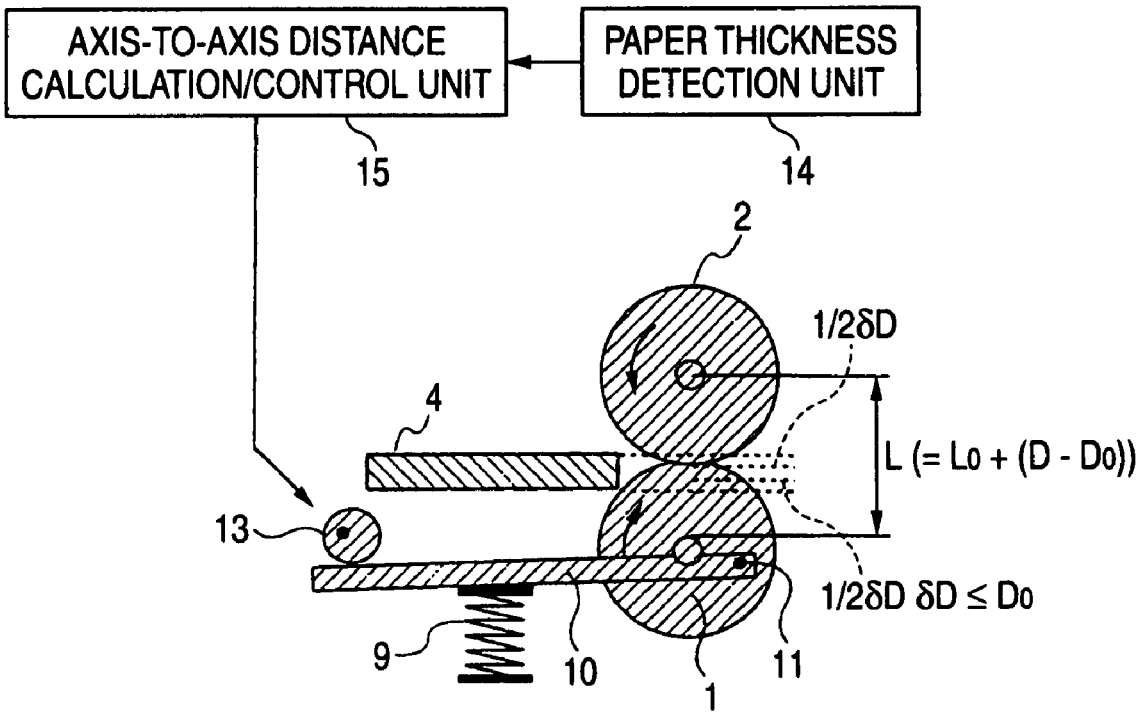
FIG. 7 is a cross-sectional side view typically showing the heat roll fixing device 700 according to a second embodiment.

Referring to FIG. 7, an embodiment 2 of the invention will be described below. FIG. 7 is a cross-sectional side view of a fixing device at the time of fixing the thick paper according to the embodiment 2 of the invention.

Reference numeral 13 denotes an axis-to-axis distance adjusting member, reference numeral 14 denotes a paper thickness detection unit, and reference numeral 15 denotes an axis-to-axis distance calculation/control unit for calculating and controlling the axis-to-axis distance based on the detection value of the paper thickness detection unit.

The constitution and action of an image making engine in this embodiment are the same as in the embodiment 1. In this embodiment, the setting of the axis-to-axis distance L is changed according to the paper thickness for transfer, and the axis-to-axis distance is fixed at any time under the condition as represented by the expression (3). Assuming that the paper thickness where there is no problem with the offset due to rush/exhaust impact or the thickness of thin paper is Do, and the paper thickness greater than Do is D, and the axis-to-axis distance between the backup roller 1 and the heat roller 2 in a state where the recording paper 4 is not nipped at the time of fixing the thin paper is Lo, the axis-to-axis distance L is represented by the following expression.

$$L=Lo+(D-Do) \tag{3}$$

The paper thickness detection unit 14 composed of a through-beam sensor detects the thickness of the recording paper delivered from a hopper for the recording paper 4 in the recording apparatus. The axis-to-axis distance calculation/control unit for control calculates the axis-to-axis distance L based on the expression (3), in which if the paper thickness is greater than the thickness Do of the thin paper where there is no problem with the offset due to rush/exhaust impact, the axis-to-axis distance adjusting member 13 is controlled so that the axis-to-axis distance may become the calculated value. The axis-to-axis distance adjusting member 13 of this embodiment uses an eccentric roller instead of the cam, so that the axis-to-axis distance L can be set corresponding to various kinds of paper thickness. Needless to say, other axis-to-axis distance adjusting mechanisms may be employed.

In this embodiment 2, the axis-to-axis distance L is the minimum value in the range as represented by the expression (1). Since this condition is equivalent to the widened distance of the axis-to-axis distance of the thin paper where there is no problem with the offset due to rush/exhaust impact when the thick paper is nipped, no force is shared among the members for axis-to-axis distance adjustment. Accordingly, there is an advantage that this condition is satisfied without taking care of the condition where no force is applied on the member for axis-to-axis distance adjustment while the thick paper is nipped, as described in the embodiment 1. In this embodiment, it is also required that the condition of the expression (2) in the embodiment 1 is satisfied. Conversely, in the embodiment 1, the paper thickness detection method and the control method as shown in this embodiment 2 may be employed.

The fixing device for electrophotography can be employed in the application where the printing is made on the thicker recording paper than before, because the occurrence of an offset due to a rush/exhaust impact in inserting the thick paper can be prevented without decreasing the degree of freedom in designing the pressing mechanism and increasing the size of the pressing mechanism. Also, the recording apparatus can be installed in a narrow space where it can not be placed conventionally.

According to the above-embodiments, since the axis-to-axis distance is expanded beforehand in inserting the thick paper through the fixing device, the expansion of the axis-to-axis distance when the thick paper rushes into the nip part is smaller than the thin paper in which there is no problem with the offset due to rush/exhaust impact, whereby the rush/exhaust impact is not increased, but the offset is not problematical. Thereby, it is possible to suppress the occurrence of offset to a level without problem by preventing the rush/exhaust impact especially without suppressing the spring constant or arm ratio of the pressing mechanism low. The fixing device or electro-photographic recording apparatus can be provided in which no misprint is produced and the long cleaning member exchange period is realized.

According to the above-embodiments, when the axis-to-axis distance is expanded beforehand in inserting the thick paper through the fixing device, the HR and the BR are contacted in the fixing device in which only one of the HR and the BR is driven, so that there is no difference in the speed between the HR and the BR, thereby preventing the occurrence of shearing stress applied on the toner at the time of fixing the thick paper. Thereby, the excellent fixing device or electro-photographic recording apparatus can be provided in more preferred mode in which the occurrence of offset can be prevented more securely, no misprint is produced and the long cleaning member exchange period is realized.

What is claimed is:

1. A fixing device for an electro-photographic recording apparatus, comprising:

a back-up roller having an elastic layer on a surface of the back-up roller; and a heating roller, wherein a nip part is formed by a pressing mechanism where the back-up roller is pressed against the heating roller, wherein an axis-to-axis distance between the heating roller and the back-up roller is set to be a first value under a first fixing condition where an offset due to a rush/exhaust impact does not have adverse effect on the recording medium in case that a thin paper as the recording medium is transported through the nip part, while the back-up roller comes into contact with the heating roller to receive a driving force from the heating roller when the recording medium is not nipped at the nip part, wherein, when a thick paper as the recording medium is fixed, the axis-to-axis distance between the heating roller and the back-up roller is set to be a second value larger than the first value under the first fixing condition, and is set to be the second value under a second fixing condition where the back-up roller comes into contact with the heating roller to receive a driving force from the heating roller.

2. The fixing device according to claim 1, when the recording medium thicker than Do under the first fixing condition is nipped and fixed, the axis-to-axis distance L between the heating roller and the back-up roller is set in a range satisfying an expression (1) $Lo+(D-Do) \leqq L < Lo+D$ and an expression (2) $Lo+D < r_H + r_B$, wherein the axis-to-axis distance under the first fixing condition is Lo, a radius of the heating roller is $r_H$, a radius of the back-up roller is $r_B$, a thickness of the recording medium under the first fixing condition is Do, and a thickness of the recording medium thicker than Do is D.

3. The fixing device according to claim 1, wherein when the recording medium thicker than Do is nipped and fixed, the axis-to-axis distance L is set to satisfy an expression (3) $L=Lo+(D-Do)$, wherein the axis-to-axis distance under the first fixing condition is Lo, a thickness of the recording medium under the first fixing condition is Do, and a thickness of the recording medium thicker than Do is D.

4. The fixing device according to claim 2, comprising:

an axis-to-axis distance adjusting member for changing the axis-to-axis distance in accordance with the thickness of the recording medium, wherein, when the recording medium thicker than the Do is nipped at the nip part of the fixing device, the axis-to-axis distance is set so at not to apply force on the axis-to-axis distance adjusting member.

5. The fixing device according to claim 1, comprising:

a paper thickness detection unit detecting the thickness of the recording medium before the recording medium reaches the fixing device; and an axis-to-axis distance calculation unit calculating the axis-to-axis distance based on the detected paper thickness, wherein the axis-to-axis distance under the first fixing condition is controlled to a value calculated by the axis-to-axis distance calculation unit.

6. An electrophotographic recording apparatus comprising: a fixing device according to claim 1.

* * * * *